United States Patent [19]

Raver

[11] Patent Number: 4,586,467

[45] Date of Patent: May 6, 1986

[54] ELECTRIC STARTING APPARATUS

[75] Inventor: Louis J. Raver, Anderson, Ind.

[73] Assignee: General Motors Corporation, Detroit, Mich.

[21] Appl. No.: 545,893

[22] Filed: Oct. 27, 1983

[51] Int. Cl.[4] ..... F02N 11/08; H01H 47/08

[52] U.S. Cl. ..... 123/179 B; 74/7 A; 290/38 R; 361/194

[58] Field of Search ..... 123/179 B; 74/7 A; 290/38 R, 38 A, 38 C, 38 B, 38 E, 38 D; 361/152, 194, 154

[56] References Cited

U.S. PATENT DOCUMENTS

| | | | |
|---|---|---|---|
| 2,287,791 | 6/1942 | Dyer | 290/38 E |
| 3,076,098 | 1/1963 | Colvill et al. . | |
| 3,551,754 | 12/1970 | Shaffer | 361/152 |
| 3,761,730 | 9/1973 | Wright | 361/194 X |
| 4,227,231 | 10/1980 | Hansen et al. | 361/194 X |

*Primary Examiner*—Tony M. Argenbright
*Attorney, Agent, or Firm*—C. R. Meland

[57] ABSTRACT

An electric starting apparatus for cranking an internal combustion engine. The electric starter is of a type that has solenoid pull-in and hold-in coils that when energized cause a solenoid plunger to shift which in turn moves a pinion into mesh with the ring gear of the engine. The hole-in coil can be energized directly from a battery when a manually operable start switch is closed. The energization of the pull-in coil is controlled by a Darlington transistor located in the solenoid housing. The transistor is biased conductive when the start switch is closed and nonconductive when the start switch is opened.

4 Claims, 1 Drawing Figure

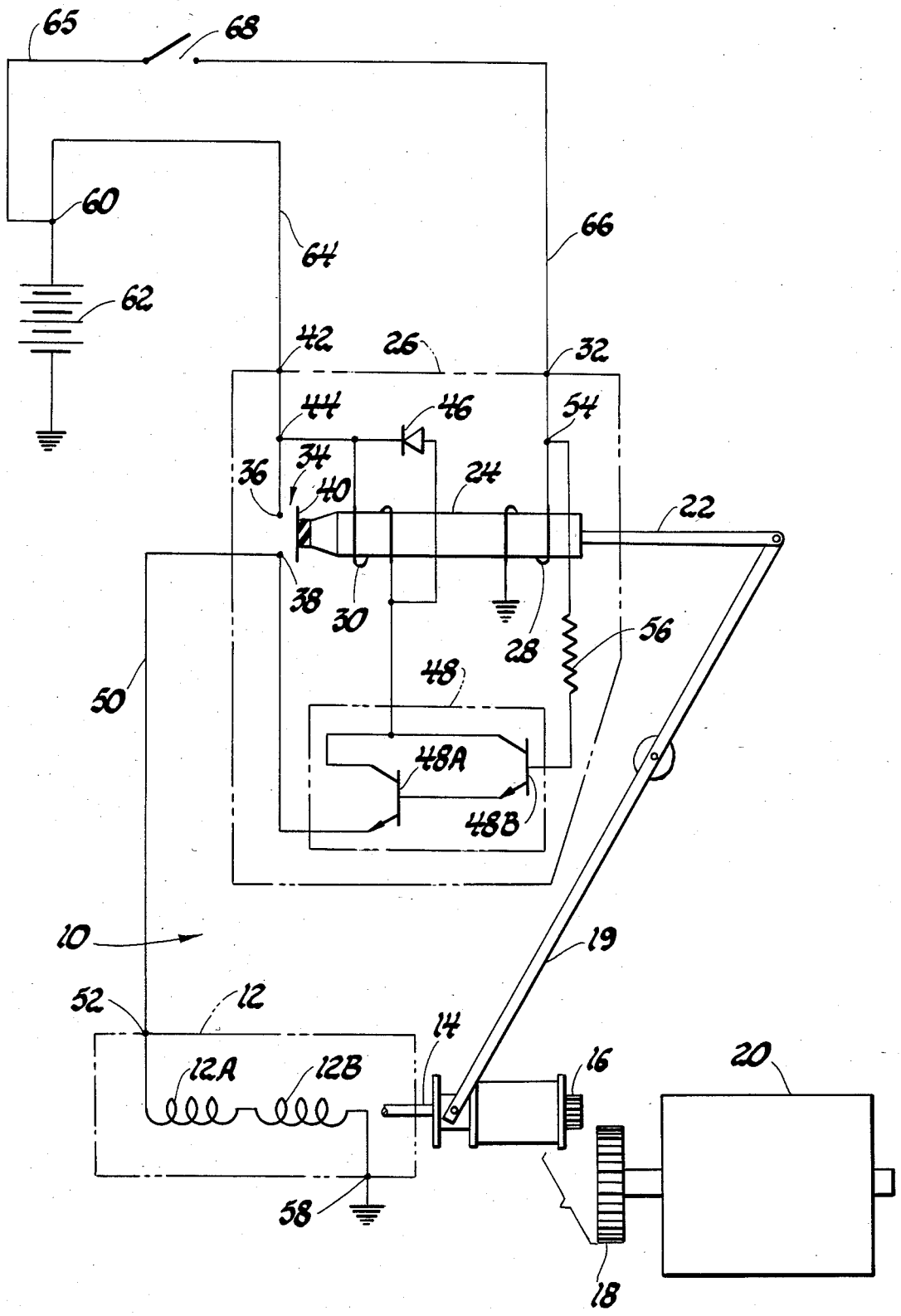
65
68
60
64
66
62
42
26
32
44
46
54
36
34
40
24
22
38
30
28
56
48
50
48A
48B
10
19
52
12
14
16
20
12A
12B
58
18

ELECTRIC STARTING APPARATUS

This invention relates to electric starting apparatus for cranking an internal combustion engine and more particularly to a starting system that utilizes an electric starter of the type that has a solenoid comprised of pull-in and hold-in coils which, when energized, shift a plunger or armature which in turn shifts a pinion into mesh with the ring gear of the engine to be cranked.

Electric starting apparatus that utilize a solenoid having pull-in and hold-in coils and a plunger that is shifted when the coils are energized to in turn shift a pinion into mesh with the ring gear of an engine are well known to those skilled in the art, examples being starters of the type disclosed in the U.S. Pat. Nos. to Dyer 2,287,791 and to Hartzell et al., 2,839,935. In starting apparatus of this type the pull-in coil has a low resistance as compared to the hold-in coil. When the coils are initially energized they both generate flux which causes the plunger or armature to shift and when the pinion has been meshed with the ring gear the pull-in winding is short-circuited by a solenoid operated switch. The higher resistance hold-in coil remains energized and it maintains the pinion meshed with the ring gear. In order to provide sufficient power to cause a meshing of the pinion with the ring gear, particularly when end tooth abutment occurs between the pinion and ring gear, a substantial current must be supplied to the coils and in particular the pull-in coil. By way of example, the two coils may require approximately 77 amps in order to ensure a meshing of the pinion with the ring gear where the starter is a 12 volt starter. Because of this high current requirement a magnetic switch is normally required to carry the energizing current for the coils with the actuating current for the coil of the magnetic switch being controlled by a start switch.

In contrast to the starting system that has just been described it is an object of this invention to completely eliminate the need for a magnetic switch to thereby reduce wiring complexity and the additional cost of the magnetic switch. In carrying this object forward the electric starter is arranged such that the hold-in coil can be directly connected across the battery by a start switch. The pull-in coil of the solenoid is connected in series with a transistor which is located within the solenoid housing. The base of the transistor is connected to the start switch so that when the start switch is closed the transistor is biased conductive to thereby electrically connect the pull-in coil in series with the cranking motor. With the arrangement that has been described, the hold-in coil may, for example, require approximately 20 amps and the transistor carries the 57 amps required by the pull-in coil.

Another advantage of the starting system of this invention results from the use of a solid state semiconductor switch to control pull-in coil current which preferably takes the form of a transistor. Thus, there are no switch contacts to make and break pull-in coil current and hence problems associated with deterioration of switch contacts due to arcing and other factors are eliminated.

As previously mentioned, the current supplied to pull-in coil may be about 57 amps. With such a large current the resistance of the circuit feeding the pull-in coil should be made as low as possible to keep the voltage drop as low as possible. With the system of this invention there are no switch contacts in the circuit that feeds the pull-in coil, the battery cable that feeds the pull-in coil has a relatively low resistance and since the transistor, that controls pull-in coil current, is located in the solenoid housing it is in close proximity to the battery terminal on the solenoid housing. These factors contribute to minimizing the voltage drop between battery and the pull-in coil.

IN THE DRAWINGS

The single figure drawing is a schematic circuit diagram of a starting system made in accordance with this invention.

Referring now to the drawing, the reference numeral 10 generally designates an electric starter. The starter 10 comprises a conventional direct voltage cranking motor designated by reference numeral 12 which has field windings designated as 12A and a rotatable armature, including armature winding designated as 12B. The motor shaft is designated by reference numeral 14 and is rotatably driven by the armature of the direct voltage cranking motor in a manner well known to those skilled in the art. The motor shaft 14 supports a pinion designated by reference numeral 16 which is meshed with the ring gear 18 of an internal combustion engine 20 when it is desired to crank the engine. The pinion 16, as is well known to those skilled in the art, can be shifted axially relative to the motor shaft 14 by a pivotally mounted shift lever designated by reference numeral 19. The shift lever 19 is coupled to the pinion in a conventional fashion and an overrunning clutch may be provided that is mechanically connected between shaft 14 and pinion 16. By way of example, the pinion may be driven from the motor shaft and axially shifted relative thereto in a manner disclosed in the U.S. Pat. No. to Schneider et al., 2,862,391. Thus, the pinion 16 may engage spiral splines on a sleeve that is shifted by the shift lever so that if end tooth abutment occurs between the pinion and the ring gear the pinion is rotated or indexed slightly when the shift lever is moved to mesh the pinion with the ring gear. Another example of a shift lever mechanism is disclosed in the above-referenced Hartzell et al. Pat. No. 2,839,935.

The shift lever 19 is pivotally connected to a link 22 which is moved by an armature or plunger 24 that forms part of the solenoid for the electric starter. The solenoid housing is designated by reference numeral 26 and is secured to the frame of the cranking motor 12 in a manner well known to those skilled in the art, for example in a manner disclosed in the above-referenced Hartzell et al. patent. The solenoid housing 26 contains a hold-in coil 28 and a pull-in coil 30. One end of the hold-in coil 28 is grounded as illustrated whereas the opposite end of this coil is connected to an input terminal for the starter designated by reference numeral 32 and carried by solenoid housing 26.

The electric starter 10 has a switch 34 comprised of fixed contacts 36 and 38 and a shiftable contactor 40 which is shifted by movement of the plunger or armature 24 of the solenoid in a known manner. When the pinion 16 is meshed with the ring gear 18 the contactor 40 bridges or electrically connects the fixed contacts 36 and 38 in a manner well known to those skilled in the art. In the drawing the contactor 40 has been shown as being carried by the armature or plunger 24 in order to simplify the description of this invention. In the actual construction of a starter the contactor 40 is carried by a plunger that is engaged and shifted by plunger 24 in a manner disclosed in the U.S. Pat. No. to Colvin et al., 4,382,242.

The electric starter 10 has another input terminal designated by reference numeral 42 which may be termed a battery terminal. The terminal 42 is electrically connected to the fixed contact 36 of switch 34 and to a junction 44. The junction 44 is electrically connected to one side of the pull-in coil 30 and a diode 46 is connected across this coil. The opposite end of the coil 30 is connected to the collectors of a Darlington transistor designated by reference numeral 48. The transistor 48 has a high current rating of approximately 100 amps and may be, for example, a Motorola Type MJ10100 Darlington NPN transistor. The Darlington transistor 48 is comprised of NPN transistors 48A and 48B and the emitter of the transistor 48A is connected to the fixed contact 38 and therefore to conductor 50. The conductor 50 electrically connects the fixed contact 38 to the terminal 52 of the direct voltage cranking motor 12.

The base of transistor 48B is connected to a junction 54 by a resistor 56. The armature winding 12B of the cranking motor 12 is connected to junction 58 which is grounded.

The terminal 42 of the starter 10 is connected to the positive terminal 60 of a storage battery 62 by a conductor or battery cable 64 and the negative terminal of the battery is grounded as shown. The input terminal 32 of the starter 10 is connected to the positive terminal 60 of the battery 62 by conductors 65 and 66 and a manually operable start switch 68. The battery 62, when utilized on a motor vehicle, is charged by an engine driven generator (not illustrated) in a manner well known to those skilled in the art.

The operation of the starting apparatus will now be described. When it is desired to crank the engine 20 the manually operable start switch 68 is closed. When switch 68 is closed the hold-in coil 28 is energized via a circuit that can be traced from terminal 60, through conductor 65, through closed start switch 68, through conductor 66 to terminal 32, and then through hold-in coil 28 to ground. The hold-in coil is therefore directly connected across the battery 62 and is energized thereby. When switch 68 is closed the transistors 48A and 48B are biased conductive in their collector-emitter circuits. Thus, closure of switch 68 applies a bias voltage to the base of transistor 48B via resistor 56 to bias the Darlington connected transistor 48 conductive. With transistors 48A and 48B conductive the pull-in coil 30 is energized via a circuit that can be traced from terminal 60, through conductor 64 to terminal 42, through the pull-in coil 30, through the collector-emitter circuit of the Darlington connected transistors, through conductor 50 to junction 52 and then through the field and armature windings of the cranking motor 12 to ground.

With the pull-in coil 30 and the hold-in coil 28 energized magnetic flux is generated thereby which causes the plunger 24 to shift toward fixed contacts 36 and 38. This movement of plunger 24 causes the shift lever 19 to pivot and causes the pinion 16 to be meshed with the ring gear 18. The movement of the plunger 24 further causes the conductor 40 to bridge or electrically connect the fixed contacts 36 and 38 when the pinion 16 is meshed with the ring gear 18. When contactor 40 engages fixed contacts 36 and 38 the cranking motor 12 is energized from battery 62 via a circuit that can be traced from terminal 60, through conductor 64 to terminal 42, through the bridged contacts 36 and 38, through conductor 50 and then through the field and armature windings of the motor 12 to ground. Since the motor 12 is now energized it causes the shaft 14 to rotate to thereby crank the engine 20. When the fixed contactor 40 engages the contacts 36 and 38 the pull-in coil 30 and the collector-emitter circuit of the Darlington connected transistor 48 are short-circuited to thereby deenergize the pull-in coil 30. The pinion is maintained meshed with the ring gear 18 because the hold-in coil 28 remains energized as long as the start switch 68 is closed.

In order to terminate cranking the start switch 68 is opened thereby deenergizing the hold-in coil 28. The opening of switch 68 removes the forward bias voltage applied to the base of transistor 48 and consequently the transistor is biased nonconductive to deenergize the pull-in coil 30. The plunger or armature 24 is now moved away from fixed contacts 36 and 38 by a return spring which is well known to those skilled in the art and which is not illustrated. This spring moves the armature or plunger and the shift lever 19 to pivot it and therefore pull the pinion 16 out of mesh with the ring gear 18.

The diode 46 is a free-wheeling diode which dissipates the transient voltage generated in the pull-in coil 30 when the transistor 48 is biased nonconductive to thereby protect the transistor.

Where the starter 10 is a 12 volt starter the hold-in coil may have a resistance of approximately 0.5 and the resistance of pull-in coil 30 may be approximately 0.175 ohms.

The conductor that connects terminal 42 and fixed contact 36 preferably takes the form of a terminal stud that extends through solenoid housing 26 and which has an integral contact portion forming fixed contact 36 as is disclosed in the above-referenced Colvin et al. Pat. No. 4,382,242.

It can be appreciated from the foregoing that the system of this invention has completely eliminated the magnetic switch that is normally required to supply, for example, 77 amps to the pull-in and hold-in coils of the starter solenoid of a conventional starting system. Further, the starting system utilizes a solid state semiconductor switching component, namely the Darlington transistor 48, as the switch for controlling the current supplied to the pull-in coil 30 so that there are no switch contacts to deteriorate due to arcing and other factors in the use of the system in this invention. It further can be seen that the installation of the cranking motor is simplified since connections only need to be made to the terminals 32 and 42 and the cranking motor grounded. Another advantage of the starting system of this invention is that voltage drops connecting the battery and the pull-in coil 30 are reduced to a minimum since the switching transistor 48 is located within the solenoid housing 26 and therefore in close proximity to the battery terminal 42.

The embodiments of the invention for which an exclusive property or privilege is claimed are defined as follows:

1. An electric starting system for cranking an engine comprising, a source of voltage, an electric starter comprising an electric cranking motor and a solenoid having pull-in and hold-in coils and a shiftable plunger, a pinion that is shifted by movement of said plunger that is adapted to mesh with the ring gear of said engine, switch means having first and second contacts that are at times electrically connected by a contactor shiftable by movement of said plunger, a manually operable start switch, means connecting said start switch and said hold-in coil in series and across said voltage source whereby said hold-in coil is energized when said start switch is closed and is deenergized when said start switch is opened, means connecting one side of said voltage source to said first contact, means connecting an opposite side of said voltage source to one side of said cranking motor, a circuit connecting said first contact to an opposite side of said cranking motor comprising in a series connection said pull-in coil and the current carrying electrodes of a semiconductor switch, a circuit connecting said second contact to said opposite side of said cranking motor, and means connecting a control electrode of said semiconductor switch to said start switch such that said semiconductor switch is biased conductive between its current carrying electrodes to energize said pull-in coil when said start switch is closed.

2. An electric starting system for cranking an engine comprising, a source of voltage, an electric starter comprising an electric cranking motor and a solenoid having pull-in and hold-in coils and a shiftable plunger, a pinion that is shifted by movement of said plunger that is adapted to mesh with the ring gear of said engine, switch means having first and second contacts that are at times electrically connected by a contactor shiftable by movement of said plunger, a manually operable start switch, means connecting said start switch and said hold-in coil in series and across said voltage source whereby said hold-in coil is energized when said start switch is closed and is deenergized when said start switch is opened, means connecting one side of said voltage source to said first contact, means connecting an opposite side of said voltage source to one side of said cranking motor, a circuit connecting said first contact to an opposite side of said cranking motor comprising in a series connection said pull-in coil and the collector and emitter electrodes of a transistor, a circuit connecting said second contact to said opposite side of said cranking motor, and means connecting the base electrode of said transistor to said start switch such that said transistor is biased conductive to energize said pull-in coil when said start switch is closed.

3. Electric starting apparatus for cranking an engine comprising, an electric starter comprising an electric cranking motor and a solenoid having pull-in and hold-in coils and a plunger that is shifted when said coils are energized, a pinion coupled to said plunger adapted to be shifted into mesh with the ring gear of an engine by movement of said plunger, an electric switch having first and second fixed contacts and a contactor shiftable by movement of said plunger for at times electrically connecting said contacts, first and second terminals carried by said starter adapted to be connected respectively to opposite sides of a direct voltage source, a third terminal carried by said starter adapted to be connected to a start switch, means connecting said hold-in coil between said third and second terminals, means connecting said cranking motor between said second contact and said second terminal, means connecting said first contact to said first terminal, a circuit connected between said first terminal and the side of said cranking motor that is connected to said second contact comprising in a series connection said pull-in coil and the current carrying electrodes of a semiconductor switch, and means connecting a control electrode of said semiconductor switch to said third terminal.

4. Electric starting apparatus for cranking an engine comprising, an electric starter comprising an electric cranking motor and a solenoid having pull-in and hold-in coils and a plunger that is shifted when said coils are energized, a pinion coupled to said plunger adapted to be shifted into mesh with the ring gear of an engine by movement of said plunger, an electric switch having first and second fixed contacts and a contactor shiftable by movement of said plunger for at times bridging said contacts, first and second terminals carried by said starter adapted to be connected respectively to opposite sides of a direct voltage source, a third terminal carried by said starter adapted to be connected to a start switch, means connecting said hold-in coil between said third and second terminals, means connecting said cranking motor between said second contact and said second terminal, means connecting said first contact to said first terminal, a circuit connected between said first terminal and the side of said cranking motor that is connected to said second contact comprising in a series connection said pull-in coil and the collector and emitter electrodes of a transistor, and means connecting the base electrode of said transistor to said third terminal.

* * * * *